United States Patent [19]

Maki

[11] Patent Number: 4,587,905

[45] Date of Patent: May 13, 1986

[54] WAD AND SLUG FOR A SHOTGUN CARTRIDGE

[76] Inventor: Nagatoshi Maki, 2-48-4, Kamiishihara, Chofu-shi, Tokyo, Japan

[21] Appl. No.: 555,150

[22] Filed: Nov. 25, 1983

Related U.S. Application Data

[63] Continuation of Ser. No. 243,546, Mar. 13, 1981, abandoned.

[30] Foreign Application Priority Data

| | | | |
|---|---|---|---|
| Jul. 18, 1980 | [JP] | Japan | 55-100718 |
| Nov. 17, 1980 | [JP] | Japan | 55-160827 |
| Nov. 17, 1980 | [JP] | Japan | 55-163495 |

[51] Int. Cl.[4] ..... F42B 7/08; F42B 7/10

[52] U.S. Cl. ..... 102/430; 102/439; 102/448; 102/501; 102/517; 102/532; 244/3.23

[58] Field of Search ..... 102/448, 439, 430, 501, 102/517–519; 244/3.23

[56] References Cited

U.S. PATENT DOCUMENTS

| | | | |
|---|---|---|---|
| 776,921 | 12/1904 | LaDow | 102/532 |
| 1,096,272 | 5/1914 | Sherman . | |
| 2,924,174 | 2/1960 | McLean . | |
| 3,058,423 | 10/1962 | Laager . | |
| 3,065,696 | 11/1962 | Klein . | |
| 3,074,344 | 1/1963 | Devaux . | |
| 3,138,102 | 6/1964 | Meyer et al. | 102/509 |
| 3,247,795 | 4/1966 | Abela . | |
| 3,398,682 | 3/1968 | Abela . | |
| 3,420,178 | 1/1969 | Rempel . | |
| 3,452,677 | 7/1969 | Abela | 102/439 |
| 3,507,220 | 4/1970 | McClure, III . | |
| 3,750,579 | 8/1973 | Bellington . | |
| 3,881,421 | 5/1975 | Burczynski . | |
| 4,016,817 | 4/1977 | Blanco | 244/323 |
| 4,043,267 | 8/1977 | Hayashi | 102/439 |
| 4,063,511 | 12/1977 | Bullard | 102/532 |
| 4,296,893 | 10/1981 | Ballmann . | |
| 4,301,733 | 11/1981 | Blanco | 102/501 |

FOREIGN PATENT DOCUMENTS

| | | | |
|---|---|---|---|
| 866822 | 11/1978 | Belgium . | |
| 96460 | 6/1897 | Fed. Rep. of Germany . | |
| 1016766 | 11/1952 | France | 102/520 |
| 1223158 | 5/1959 | France . | |
| 1454361 | 9/1966 | France . | |
| 2066065 | 10/1970 | France . | |
| 2199861 | 4/1974 | France . | |
| 2218546 | 9/1974 | France . | |
| 2292948 | 6/1976 | France . | |
| 2372411 | 6/1978 | France . | |
| 606149 | 7/1983 | Italy . | |
| 18097 | of 1905 | United Kingdom . | |
| 172710 | 12/1921 | United Kingdom . | |

*Primary Examiner*—Harold J. Tudor

*Attorney, Agent, or Firm*—Merchant, Gould, Smith, Edell, Welter & Schmidt

[57] ABSTRACT

An assembly of a wad and a slug for a shotgun cartridge, the wad and the slug being coaxially connected to each other by means of male and female connectors provided on the wad and the slug without play between the connectors, the assembly comprising peripheral projections spaced from one another in the axial direction of the assembly.

5 Claims, 30 Drawing Figures

WAD AND SLUG FOR A SHOTGUN CARTRIDGE

This is a continuation of application Ser. No. 243,546, filed 3/13/81 now abandoned.

DESCRIPTION OF THE INVENTION

This invention relates to a shotgun cartridge for use with a shotgun having a non-rifle barrel, and particularly to a wad and a slug of the cartridge.

In hunting large game animals such as wild boars and deer, not only rifles but also shotguns are used. Generally speaking, the shotguns are inferior to the rifles for accuracy, lesser the probability of hitting and are inferior in kill power. However, in case where game is located at a short distance, for example, within fifty yards, the shotgun is advantageous, because it is relatively light and accordingly it is easy carry it over hills and fields, and because it is easily operable, resulting in making it possible to quickly shoot (snap-shoot) the game. Furthermore, only shotguns can be used in localities where the use of rifles is not permitted.

When hunting large game animals with a shotgun, a slug load is used in which a single bullet is fired. Such a known slug load is typically illustrated in FIGS. 1–3. FIG. 1 shows a sectional view of a slug load passing through a barrel 6 of a shotgun (not shown), after being fired. The slug load essentially has a wad 1 and a slug 8 provided on the wad 1. The slug load has a case (not shown) with a primer (not shown). In the case is located gunpowder adjacent to the wad 1. Since FIG. 1 shows a fired slug load during the passage through the barrel, neither case nor gunpowder is illustrated. A barrel bore 7 is filled with an explosive gas. The wad 1 has members 2 which are deformable under buckling, intermediate plate 3 located between the deformable members 2, and a seat 4 which is adapted to receive the slug 8, as shown in FIGS. 2 and 3. The wad 1 has an integral cushion device thus formed. The cushion device can be replaced by a filler wad (not shown) which has an elastic cylindrical body made of a compressible fibrous material, such as felt or paper.

Some shotguns have barrels in which portions adjacent the top ends of the muzzles thereof are choked so that the portions have diameters smaller than the diameter of the standard bore. Therefore, the slug has usually a diameter smaller than the standard bore diameter, so that the choked portion of the barrel can be free from a large stress which otherwise occurs in the choked portion when the slug which is usually made of lead alloy passes therethrough.

There is a possibility that the cushion device or the filler wad arranged between the wad which is subject to an explosive pressure and the slug which has a high inertia resistance is deflected or displaced from its center position, due to the buckling or compression of the cushion device or the filler wad. As a result of this deflection or displacement, the seat 4 can be inclined at an angle $\alpha$ with respect to a plane normal to the center axis of the barrel bore 7, which results in the slug 8 being inclined at the angle $\alpha$ with respect to the center axis of the barrel bore, as shown in FIG. 1. Consequently, between the slug 8 and the inner wall of the barrel 6 are provided asymmetrical spaces 5*a* and 5*b*. That is, the slug 8 passes through the barrel bore and is ejected from the barrel, while being inclined at an angle $\alpha$. This means that even when the slug has a diameter smaller than the barrel bore diameter by 40″/1000 or more, a large amount of lead of which the slug is made is linearly stuck or applied onto the inner wall of the barrel bore, which has been experimentally confirmed. In addition, it has been also experimentally found that slugs fired into a soft soil had partially attrited scratches formed on the outer peripheries of the recovered slugs.

These experimental results will be analyzed below in more detail.

Theoretically, as long as the slug having a diameter smaller than the barrel bore diameter has a cushion device consisting of a synthetic resin wad capable of uniform buckling or a filler wad having a uniform thickness, no inclination of the slug must occur when it is fired from the barrel, since no radial force or pressure acts on the slug. However, actually, the buckling deformation or compression of the cushion device or the filler wad occurs unevenly, which results in the inclination of the axis of the slug which is then subject to a lateral pressure. Consequently, the outer periphery of the slug is partially attrited by the inner wall of the barrel.

It will be easily understood that when the inclined slug is thrown from the barrel, it flies in a direction deflected from a target, so that the hit probability decreases.

The object of the present invention is to eliminate the drawbacks mentioned above, by providing an improved wad and slug which will ensure that the slug can be fired from the barrel in alignment with the barrel axis without having any undesirable influence on the choked barrel portion and which present a high hit probability.

The invention will be now discussed below in detail with reference to the accompanying drawings which show preferred embodiments of this invention and in which.

Figure 1:
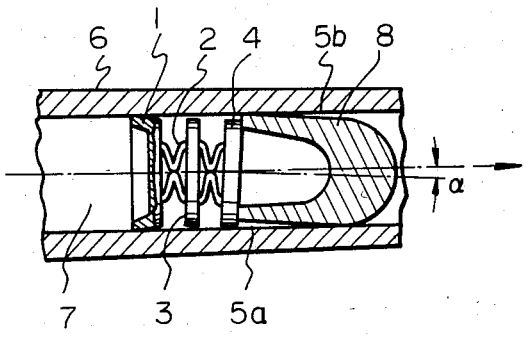
Fig. 1 PRIOR ART
FIG. 1 is a sectional side view of a known wad and a slug during passage through a shotgun barrel, according to a prior art.

The shotgun cartridge essentially includes a case 9 with a bottom, a primer 10, and anvil 11, gunpowder 12, a wad 13, and a slug 14. The numeral 15 designates a crimp of the case 9.

Figure 4:
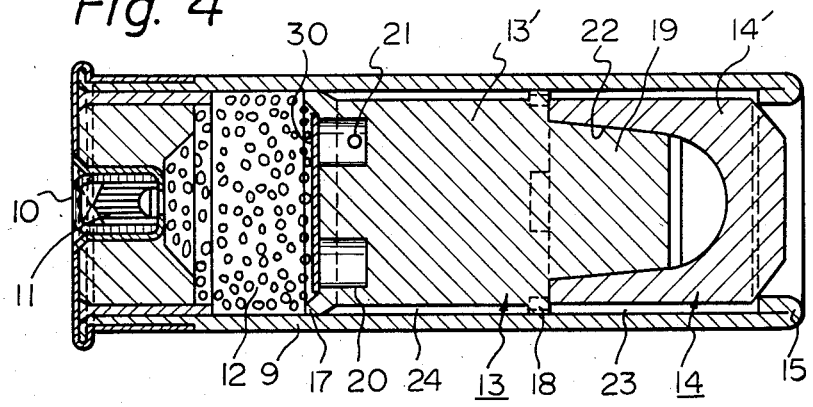
FIG. 4 is a sectional side view of a shotgun cartridge, according to the present invention.
Figure 5:
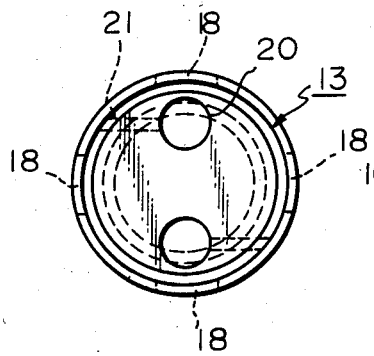
FIG. 5 is a bottom end view of a wad shown in FIG. 4.
Figure 6:
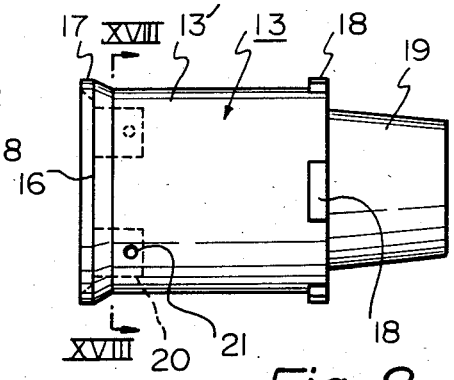
FIG. 6 is a side elevational view of FIG. 5.

The wad 13 according to this invention has a cylindrical body 13' which can be made of, for example synthetic resin being strong enough to bear against the explosive pressure and a flexibility, such as polyethylene, as shown in FIGS. 5 and 6. The cylindrical body 13' of the wad 13 is provided, on its bottom end facing the gunpowder 12 (FIG. 4), with a recess 16 having a peripheral projection 17. The peripheral projection 17 has a diameter substantially equal to the inner diameter of a barrel bore 7 (FIG. 1) (i.e. standard bore diameter), to provide a gas seal between the wad 13 and the case 9. Alternatively, the wad 13 can be made of a compressible material and in this case, the recess 16 can be dispensed with. That is, the wad can have a flat bottom end with a peripheral projection 17 which has a diameter slightly larger than the inner diameter of the barrel bore to provide the same gas seal as mentioned above.

The diameter of the cylindrical body 13' is such that a peripheral annular gap 24 is provided between the cylindrical body 13' and the case 9. The wad 13 has a plurality of spaced peripheral projections 18 integrally provided on the periphery of the cylindrical body 13 at its top end. The projections 18 are brought into smooth contact with the inner wall of the barrel bore. The number of the projections 18 is four in the illustrated embodiment but is not limited to four. Further, the wad 13 has a truncated cone shaped male member 19 which integrally projects from the top end of the cylindrical body 13'. A circle outlining the periphery of the projection 17, an imaginary circle outlining the projections 18, and the male member 19 are coaxially arranged so as to have a common axis lying on an axis of the cylindrical body 13'.

The slug 14 according to the invention has a cylindrical body 14' having a tapered center blind hole 22 which is complementary to the truncated cone shaped male member 19 so that the latter can be press-fitted in the blind hole 22. The slug 14 has a diameter slightly smaller than the inner diameter of a choked barrel portion (not shown), so that a peripheral annular gap 23 is provided between the slug 14 and the inner wall of the case 9. The slug 14 is secured to the male member 19 of the wad 13, for example, by means of set screws (not shown) after the male member 19 is press-fitted in the blind hole 22. Accordingly, the wad 13 and the slug 14 are coaxially interconnected and are coaxially located in the case 9. The slug 14 is held in the case 9 so as not to come out of the case 9, by means of the crimp 15 of the case 9. The term "press-fit" used herein refers not only to an interference fit but also to non-interference fit and does not include a play fit.

Figure 9:
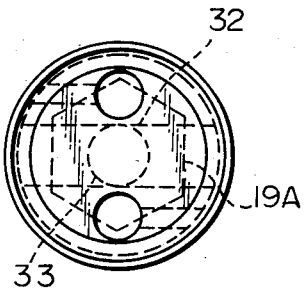
FIGS. 9 and 10 are bottom end and side elevational views of another embodiment of a wad, respectively.
Figure 10:
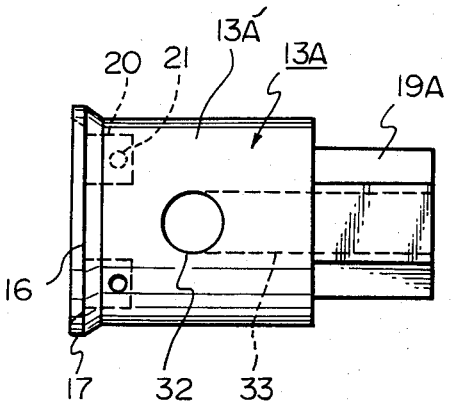

FIGS. 9 and 10 show a variant of a wad. In this variant, the wad 13A does not have projections corresponding to the projections 18 of FIG. 6, and the male member 19 of FIG. 6 is replaced by a rod 19A having a hexagonal shape in sections which is coaxially connected to a cylindrical body 13A'.

Figure 11:
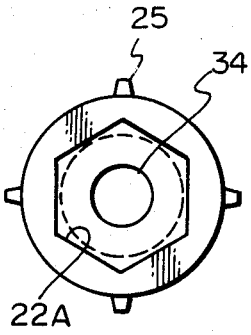
FIGS. 11 and 12 are bottom end and side elevational views of another embodiment of a slug, respectively.
Figure 12:
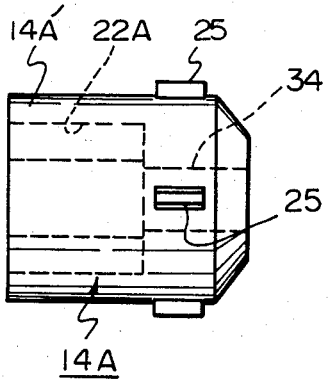

FIGS. 11 and 12 show a variant of a slug. In FIGS. 11 and 12, the slug 14A has a cylindrical body 14A' which has a hexagonal blind hole 22A corresponding to the hexagonal rod 19A of the wad 13A in FIGS. 9 and 10, so that the rod 19A can be coaxially press-fitted in the blind hole 22A. The cylindrical body 14A' which has a diameter smaller than the inner diameter of the case 9 (FIG. 4) has a plurality of spaced peripheral projections 25 which can come into smooth contact with the inner wall of the barrel bore and which can be easily deformed when the slug 14A passes through the choked barrel portion.

Figure 13:
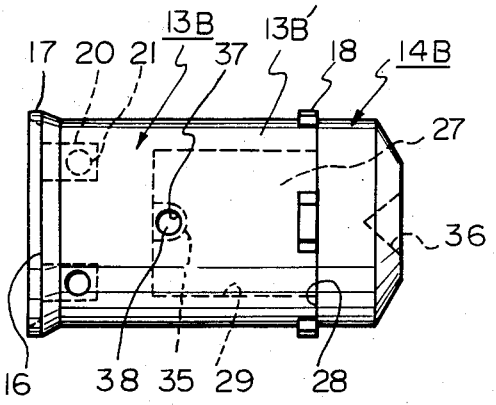
FIGS. 13 and 14 are side elevational and bottom end views of another embodiment of an assembly of a slug and a wad, respectively.
Figure 14:
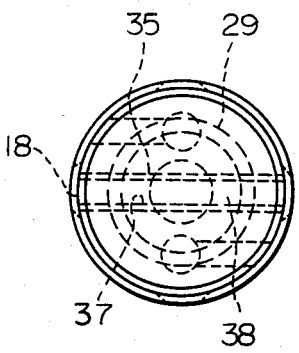
Figure 15:
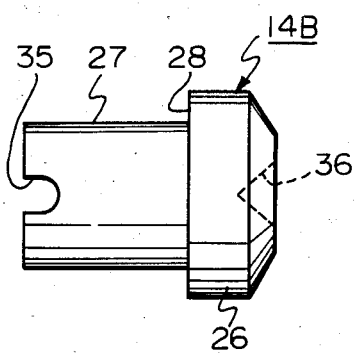
FIGS. 15 and 16 are side elevational and bottom end views of a slug shown in FIGS. 13 and 14, respectively.

Still another embodiment of an assembly of a wad and a slug (FIGS. 15 and 16) is illustrated in FIGS. 13 and 14. The slug 14B shown in FIGS. 15 and 16 has a rod (cylindrical body) 27 and a bullet head 26 integral with the rod 27 and presents a generally "mushroom" shape. The head 26 has an outer diameter slightly smaller than the inner diameter of the choked barrel portion so that an annular gap equivalent to the gap 23 in FIG. 4 is provided between the head 26 and the case 9 (FIG. 4). The wad 13B shown in FIGS. 13 and 14 has a cylindrical body 13B' which is provided with a plurality of spaced peripheral projections 18, similarly to an embodiment shown in FIG. 6. The wad body 13B' has, at its top end facing a bottom face 28 of the head 26, a center blind hole 29 in which the slug rod 27 can be press-fitted. The depth of the blind hole 29 is equal to or larger than the axial length of the rod 27. When the wad 13B and the slug 14B are assembled together, the bottom face 28 of the head 26 of the slug 14B tightly bears against the top face of the wad body 13B', so that the assembly has the same axis and is arranged in the case 9.

In the embodiments mentioned above which do not have a cushion device, the shape in section of the male member (19, 19A or 27) and the female member (22, 22A or 29) is not limited to a circle or hexagonal, but may be an other symmetrical shape, such as a polygon or a cross.

Components designated by the numerals 20, 21, 30, 32–38 in the above mentioned embodiments will be explained hereinafter.

When a firing pin (not shown) of a shotgun strikes the primer 10, the gunpowder 12 is exploded so that the gas seal portion i.e. the projection 17 of the wad 13 is radially expanded outward by the explosive gas, which results in the establishment of a complete gas seal. Consequently, the slug 14 (or 14A, 14B) is pressed forward together with the wad 13 (or 13A, 13B), by the explosive pressure, so that the crimp 15 is released and the assembly of the slug and the wad is ejected from the case 9 and then passes through the barrel bore 7 (FIG. 1) and is finally fired from the muzzle of the barrel 6 (FIG. 1).

During the passage of the assembly through the barrel bore, the wad 13 maintains its original position, that is, the axis of the wad is always in alignment with the axis of the barrel, since when the wad moves in the barrel bore which has an inner diameter substantially equal to the inner diameter of the case 9, the projection 17 and the projections 18 (or 25) located on the bottom end and the top end of the wad (or on the periphery of the slug 14), respectively are always in contact with the inner wall of the barrel bore. Furthermore, since the slug 14 is coaxially connected to the wad 13, the axis of the slug is also always in alignment with the axis of the barrel. Therefore, in the present invention, the slug can be fired from the muzzle along the barrel axis.

As can be understood from the above discussion, in the three embodiments illustrated in FIGS. 4–16, the wad 13, 13A or 13B and the slug 14, 14A or 14B can be coaxially and integrally interconnected in a press-fit fashion and can be fired from the muzzle along and on the extension of the barrel axis, thus resulting in an increase of the hit probability.

In order to stabilize the attitude of the slug during traveling in the air after being fired from the muzzle and to further increase the hit probability of the shotgun, it is desirable to give a rotational movement to the wad and the slug, about their axis which coincides with the barrel axis, as in a rifle bullet. The discussion will be now directed to the rotation of the wad and the slug.

In conventional slug loads on the market, a slug which is fired at a muzzle velocity above 1,300 ft/sec. flies at a mean velocity above the sonic velocity within a shooting range. A conventional slug on the market usually has a body consisting of a semispherical nose and a hollow cylinder integral with the nose, as shown in FIG. 1. The slug is usually provided, on its outer periphery, with several or ten and more blades inclined with respect to the axis of the slug. Because of the presence of these blades, the slug is far from a streamline shape, and, accordingly, when the slug moves at a high velocity as mentioned above, a boundarylayer separation of an air current occurs, which results in the production of unstable vortexes in the vicinity of the outer periphery of the slug. The vortexes adjacent to the periphery of the slug causes a high velocity air current to flow far from the outer periphery of the slug. Consequently, such a high velocity air current cannot collide with the blades, so that slug which can be rotated by the collision of the air current with the blades cannot be expected to be rotated. That is, the blades hardly cause the slug to rotate.

In order to ensure that the slug is rotated, according to the present invention, the explosive pressure of the gunpowder is partly used to give a torque to the wad which is passing through the barrel bore. By this torque, the wad, and accordingly the slug can be rotated at the number of velocity at least enough to provide a so called "gyro effect", so that the slug has a stable attitude.

The rotation of the slug will be explained below, with reference to FIGS. 4–8 and 18.

Figure 18:
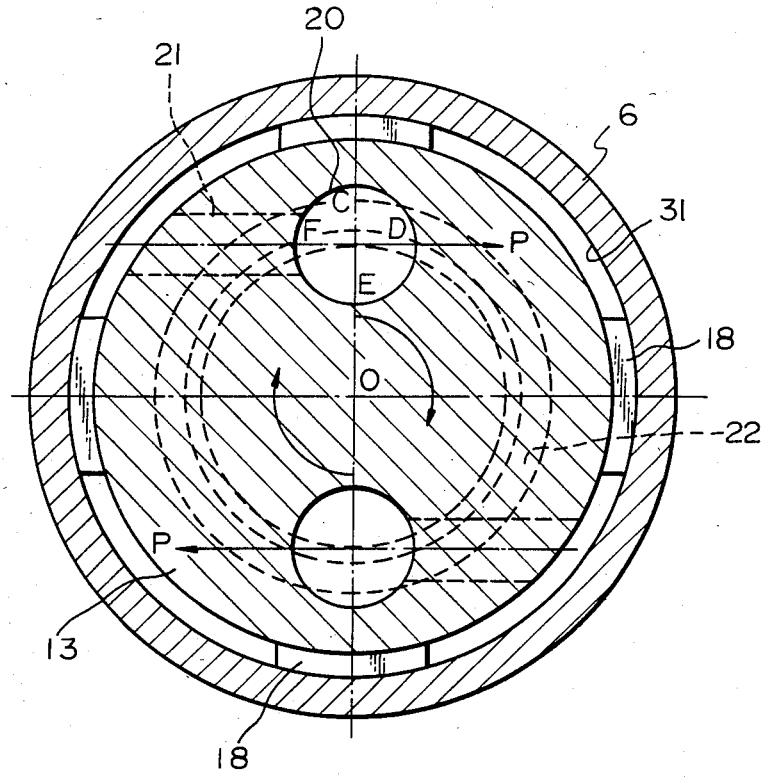
FIG. 18 is a sectional view taken along the line XVIII—XVIII in FIG. 6.

As can be seen from FIGS. 6 and 18, the wad body 13' has two or more blind holes 20 which are equiangularly spaced and are located on the same imaginary circle having a center 0 (FIG. 18), in the recess 16. Each hole 20 has a restriction passage 21 which is connected to the hole 20 near the bottom of the hole 20 and which is connected to the outer periphery of the wad 13. The passages 21 extend perpendicular to the axes of the respective blind holes 20 in different directions so as to rotate the wad 13 in a predetermined direction. In the illustrated embodiment, since two holes 20 are diametrically arranged, the two passages 21 extend in opposed directions.

Figure 7:
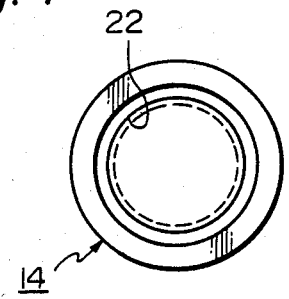
FIG. 7 is a bottom end view of a slug shown in FIG. 4.
Figure 8:
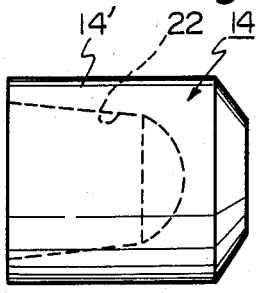
FIG. 8 is a side elevational view of FIG. 7.

A slug load or cartridge according to the present invention which has the wad 13 shown in FIGS. 5 and 6 and the slug 14 shown in FIGS. 7 and 8 is illustrated in FIG. 4, in which the wad 13 is located on the gunpowder 12. The blind holes 20 are covered by a disc cover 30 which is attached to the bottom face of the recess 16 to prevent the gunpowder from coming into the blind holes 20. The disc cover 30 is made of a material which can be broken under the initial explosive pressure of the gunpowder 12. In case where the gunpowder which is compacted by the pressure at the loading of the gunpowder is such that it does not get out of shape even without the cover, the disc cover 30 can be dispensed with. The gap 24 is defined between the wad 13 and the inner periphery of the case 9, by the gas seal i.e. the projection 17 and the projections 18. The gap 23 which is defined between the slug 14 and the inner periphery of the case 9 is connected to the gap 24, by means of circumferential spaces provided between the spaced projections 18. Alternately, in case where the spaced projections 18 are replaced by a single annular projection (not shown) or where the projections 18 are dispensed with, by providing a wad body having a diameter substantially equal to that of the projection 17, a plurality of channels which extend in parallel to the axis of the wad 13 can be provided on the periphery of the wad 13 to connect the restriction passages 21 and the gap 23.

In embodiments shown in FIGS. 9–12, the wad 13A additionally has an exhaust gas passage 32 diametrically extending to the outer periphery of the wad body 13A', and an exhaust gas passage 33 which extends perpendicularly to the passage 32 on the axis of the wad body from the passage 32 to the top face of the rod 19A. The slug 14A has a center vent 34 which can be connected to the passage 33 of the wad 13A when the slug 14A and the wad 13A are assembled together.

In embodiments illustrated in FIGS. 13–17, the rod 27 of the slug 14B (FIGS. 15 and 16) has at its bottom end a diametrically extending groove 35. Furthermore, the head 26 of the slug 14B has at its top end a recess 36 which is, for example, conical. The recess 36 causes the head 26 to be cracked or deformed when the head 26 is hit into a game, so that the kill power can be increased.

The wad 13B (FIGS. 13 and 14) has a diametrically extending hole 37 which has a diameter smaller than the width of the groove 35 of the slug 14B and which is centrally located in the groove 35 when the rod 27 of the slug 14B is completely press-fitted in the blind hole 29 of the wad 13B. In the hole 37 is press-fitted a pin 38 shown in FIG. 17 which has an axial length equal to the diameter of the wad body 13B'. The pin 38 is adapted to positively transmit the torque of the wad 13B to the slug 14B. When the wad 13B and the slug 14B are assembled together, the groove 35 extends parallel to the pin 38, as shown in FIGS. 13 and 14.

Figure 30:
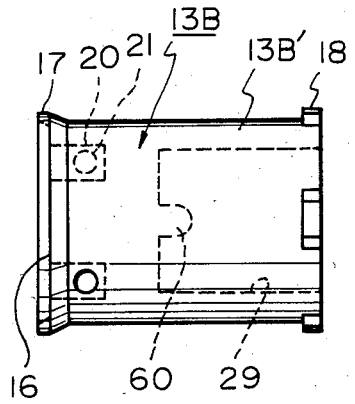

Alternatively, the pin 38 can be dispensed with and instead thereof, a diametrically extending projection 60 can be provided on the bottom of the blind hole 29, as shown in FIG. 30. In FIG. 30, the projection 60 has a profile corresponding to the profile of the groove 35 (FIG. 15) of the slug 14B, so that the projection 60 can be fitted in the groove 35 in order to transmit the rotational movement of the wad to the slug. The combination of such a male element (the projection 60) and a female element (the groove 35) can be provided between the mating faces of the wad and the slug.

It should be noted that the torque of the wad can be transmitted to the slug, by means of various kinds of connection systems between the wad and the slug, such as a press-fit connection which utilizes a frictional force between the wad and the slug, set screws which integrally connect the wad and the slug, polygonal, oval or cross shaped connectors which are complemental to each other, serration connectors, or convex and concave connectors.

When the firing pin (not shown) strikes the primer 10 to explode the gunpowder, an explosive gas is produced. When the explosive pressure reaches approximately 70 lb/in$^2$, the disc cover 30 (FIG. 4) is broken, so that a part of the explosive gas comes into the blind holes 20 and is ejected into the gap 24 through the restriction passages 21. The explosive gas which is ejected from the restriction passages 21 and which is an exhaust gas is discharged into the atmosphere ① through the gap 24, gap 23 and the crimp 15 which has heen opened or released by the slug 14 when the explosion has occurred, in FIGS. 5–8, or ② partly through the gap 24, gap 23, and the crimp 15, and partly through the gap 24, the exhaust gas passages 32 and 33, the vent hole 34 and the muzzle, in FIGS. 9–12, or ③ through the gap 24, gap 23, and the crimp 15, in FIGS. 13–16.

The ejection of a part of the explosive gas from the restriction passages 21 produces a torque of the wad 13 (or 13A, 13B) due to the jet propulsion, so that the wad can be rotated in a predetermined direction. The rotation of the wad is transmitted to the slug 14 (or 14A, 14B) during the passage thereof through the barrel bore. Thus, the assembly of the wad and the slug can be fired from the muzzle while rotating in a predetermined direction.

How the wad can be rotated by the explosive gas is as follows:

When, in FIG. 18, the pressure receiving area of the side portion of the inner wall of each of the blind holes 20 as indicated by letters CDE is compared to that indicated by letters EFC, it will be seen that the former is larger than the latter by the effective sectional area of each of the restriction passages 21 because each restriction passage opens toward that EFC side. Accordingly, a pressure difference takes place between the pressure receiving areas of both of the above-mentioned sides due to the difference in width between their pressure receiving areas and forces P acting in the directions of arrows in FIG. 18 generate whereby a torque about the central point 0 of the wad is obtained.

By properly designing the sectional area of the restriction passages 21, the assembly has a desirable number of revolutions when it comes to the muzzle. Thus, according to the present invention, a rotating slug can be fired by a shotgun having non-rifle barrel, as if by a rifle, with a high hit probability.

Figure 2:
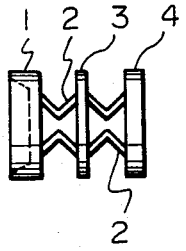
Fig. 2 PRIOR ART
FIG. 2 is a side view of a known wad shown in FIG. 1.
Figure 3:
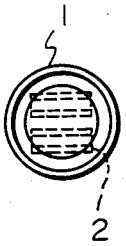
Fig. 3 PRIOR ART
FIG. 3 is bottom end view of FIG. 2.

In the embodiments mentioned above, illustrated in FIGS. 4–18, no cushion means is provided between the wad and the slug. However, it is also possible to provide such a cushion means between the wad and the slug. Generally, a slug load is usually used to hunt large game animals and, accordingly, is required to have a higher muzzle velocity than an equivalent shot load in order to have a sufficient penetration power within an expected shooting range and to decrease the ballistic drop rate. For this requirement, the amount of gunpowder to be used for a slug load is larger by 20–30% than that of an equivalent shot load. Furthermore, the slug has usually a projecting top end, which requires a long crimp to prevent the top end from coming out of the case when the slug is loaded in the case. The long crimp increases the resistance which is applied to the slug when the crimp is released. The increase of the amount of gunpowder and the resistance increases the maximum explosive pressure in the barrel bore, which is dangerous and causes a hunter to feel a large recoil (or kick) on his shoulder, when fired. These problems can be solved by providing a cushion means for rapidly damping the initial high explosive pressure. However, as mentioned above, in a conventional known cushion device (FIGS. 1–3) or filler wad, the axis thereof can be curved or deflected when it is deformed to absorb the explosive pressure, thus resulting in a decrease of the hit probability. That is, in order to obtain a high hit probability, it is necessary to fire the assembly of the wad and the slug which are in alignment with each other on the same axis from the muzzle in such a way that the axis of the assembly coincides with the barrel axis. That is, it is most important to prevent the wad and the slug from being deflected from their axis during the passage thereof through the barrel bore, in order to ensure a high hit probability.

such a cushion means for absorbing the initial explosive pressure without any deflection or inclination of the wad and the slug.

Figure 20:
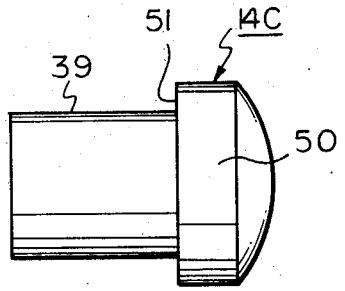
FIGS. 20 and 21 are side elevational and bottom end views of a slug shown in FIG. 19, respectively.
Figure 21:
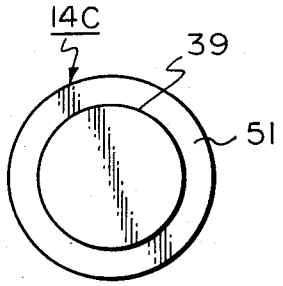
Figure 22:
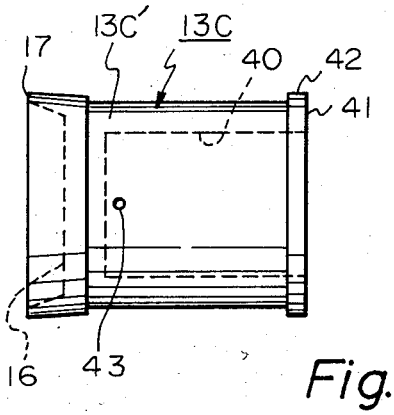
FIGS. 22 and 23 are side elevational and bottom end views of a wad shown in FIG. 19, respectively.
Figure 23:
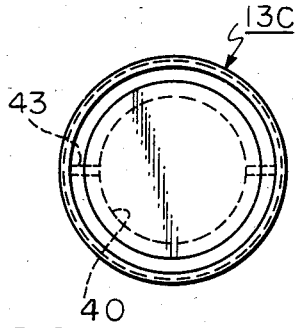

A slug 14C shown in FIGS. 20 and 21 has a head 50 and a plunger 39 integrally connected to the head 50 at a bottom face 51 of the head 50. The head 50 has an outer diameter smaller than the barrel bore diameter. On the other hand, a wad 13C, as shown in FIGS. 22 and 23 has a cylindrical body 13C' with a cylinder bore 40 in which the plunger 39 of the slug 14C can be press-fitted. The cylindrical body 13C' is provided, on its top end 41, with a peripheral projection 42 which can be replaced by a plurality of spaced projections, as is similar to the embodiments mentioned above, and which has an outer diameter substantially equal to the inner diameter of the barrel bore. The wad 13C has a bottom recess 16 and a bottom projection 17 which provides a gas seal, similar to FIGS. 6, 10 or 13. The cylindrical body 13C' has small vents 43 which are connected to the bore 40 in the vicinity of the bottom of the cylinder bore 40 and which laterally extend through the cylindrical body 13C'. Alternately, the small vents 43 can be replaced by an axial channel (not shown) for discharging air in the cylinder bore 40, provided on the outer periphery of the plunger 39 of the slug 14C or on the inner periphery of the cylindrical body 13C' of the wad 13C. Furthermore, it is also possible to provide a small center hole (not shown) which extends through the plunger 39 and the head 50, in place of the small vents 43.

Figure 19:
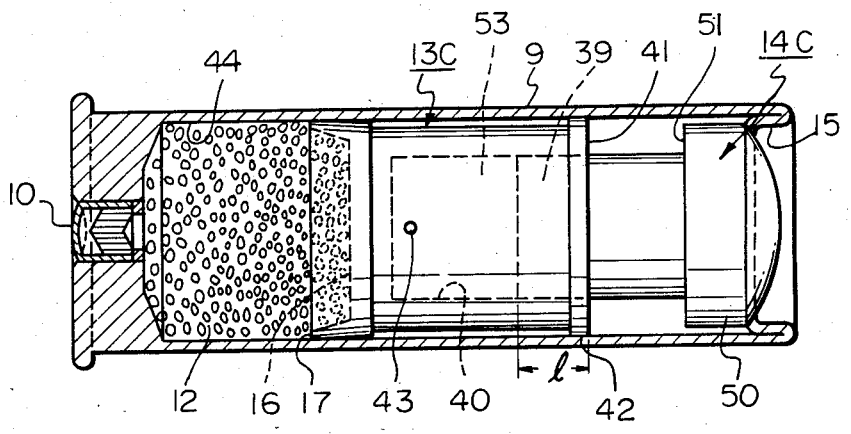
FIG. 19 is a sectional side view of another embodiment of a shotgun cartridge, according to the present invention.

FIG. 19 shows a shotgun cartridge or load which comprises the wad 13C and the slug 14C which are located in the case 9 with the primer 10. The wad 13C is located in the case 9 in such a way that the recess 16 faces the gunpowder 12 in a gunpowder chamber 44. The slug 14C is press-fitted in the wad 13C in such a way that the plunger 39 of the slug 14C is inserted in the cylinder bore 40 of the wad 13C with a predetermined insertion length l so as to provide an air cushion chamber 53 defined in the cylinder bore 40 by the plunger 39. The head 50 of the slug 14C bears against the crimp 15 of the case 9.

Figure 27:
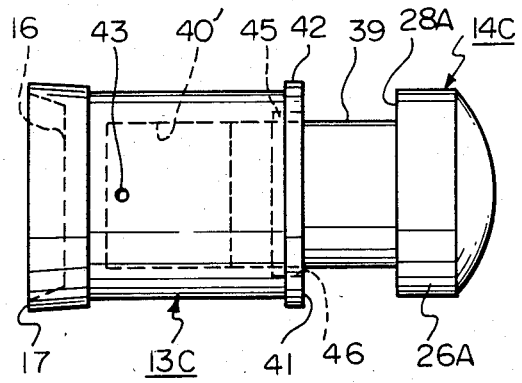
FIG. 27 shows a variant of an assembly of a wad and a slug shown in FIG. 19.

FIG. 27 shows a variant of FIG. 19. A difference between FIG. 19 and FIG. 27 resides only in that the cylinder bore 40 of the wad 13C is replaced by a stepped bore 40' having a stepped portion 46 with a larger diameter. The stepped portion 46 is located at the top end 41 of the wad 13C. The stepped portion 46 has a diameter larger than the outer diameter of the plunger 39 and has an axial length (depth) slightly longer than the axial length (width) of the projection 42, so that a peripheral space 45 can be provided between the plunger 39 and the stepped portion 46 when the plunger 39 is inserted in the cylinder bore 40' of the wad 13C.

Figure 25:
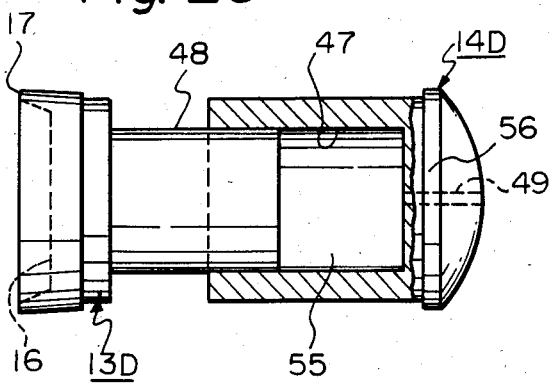
FIGS. 25 and 26 are partially sectioned side elevational and bottom end views of another embodiment of an assembly of a wad and a slug according to the present invention.
Figure 26:
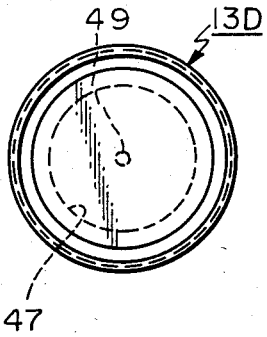

In another embodiment illustrated in FIGS. 25 and 26, the slug 14D has a cylinder bore 47 which provides an accumulation chamber or cushion chamber 55. The head 56 of the slug 14D has a diameter substantially equal to the inner diameter of the barrel bore so that the head 56 comes into smooth contact with the barrel bore. The head 56 can be easily deformed when it passes the choked barrel portions, so that the slug is free from an excess stress which otherwise would produce. The head 56 has a small center vent 49 located on the axis of the head and connected to the cylindrical bore 47. On the other hand, the wad 13D has a plunger 48 which is press-fitted into the cylinder bore 47 of the slug 14D. In the embodiment shown in FIGS. 25 and 26, a projection (or projections) corresponding to the projection 42 in FIG. 22 is dispensed with.

The embodiment shown in FIGS. 19–24 operates as follows. The operation of the embodiment shown in FIGS. 25 and 26 is substantially the same as that of the embodiment in FIGS. 19–24.

Figure 24:
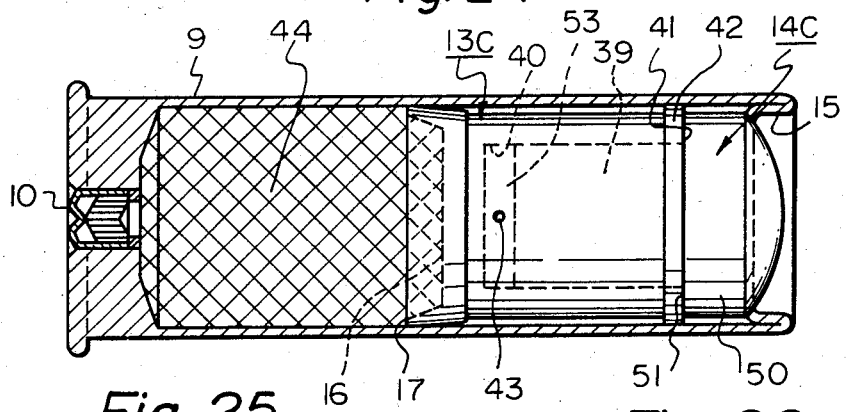
FIG. 24 shows a shotgun cartridge of FIG. 19 in a different position.

When the firing pin (not shown) strikes the primer 10 as shown in FIG. 19, the gunpowder 12 in the gunpowder chamber 44 is exploded. The wad 13C which is subject to the explosive pressure immediately after the explosion moves forward to press the slug 14C so that the slug 14C tends to move and come out of the case 9. However, since the slug 14C bears against the crimp 15 of the case 9, the slug 14C cannot move. Consequently, the wad 13C moves to slide on the plunger 39 which is held immovably by the crimp 15. That is, the relative sliding movement occurs between the slug 14C and the wad 13C. When the wad 13C slides on the plunger 39 of the slug 14C, the wad 13 is subject to the sliding resistance between the cylinder bore 40 and the plunger 39 and the compression resistance by the air compressed in the cushion chamber 53. As a result of this movement of the wad 13C, the volume of the cushion chamber is decreased and the volume of the gunpowder chamber 44 is increased or expanded, as shown in FIG. 24 in which the top end 41 of the wad 13C comes in contact with the bottom face 51 of the head 50 of the slug 14C. Further increase of the explosive pressure causes the wad 13C and the slug 14C to be ejected from the case 9 togehter after the crimp 15 is released by the slug 14C.

As can be understood from the above discussion, the explosive pressure immediately after the explosion occurs can be damped or absorbed by the relatively slow increase or expansion of the volume of the gunpowder chamber 44, so that the maximum pressure in the barrel bore can be decreased, which results in the decrease of a heavy recoil (or kick) which a hunter would feel undesirable.

As is apparent from the above discussion, the wad 13C and the slug 14C which are interconnected in the case 9 so as to have the same axis are fired from the case 9 and pass through the barrel bore. Since the internal pressure of the cylinder bore 40 is released from the vents 43, the slug 14C can be prevented from coming out from the wad 13C by the internal pressure of the cushion chamber 53. That is, the slug 14C and the wad 13C fly together after they are fired from the muzzle of the shotgun.

The space 45 (FIG. 27) between the plunger 39 of the slug 14C and the stepped portion 46 of the wad 13C is particularly useful for a choked barrel shotgun. Through the space 45, the wad 13C can be easily deformed, that is, the wad 13C can be easily subject to a radial buckling, at the projection 42, when the projection 42 of the wad 13C passes the choked barrel portion (not shown). The radial deformation of the wad 13C at the projection 42 causes the choked barrel portion to be free from excess stress. Therefore, if the wad 13C is made of a material having a high compressibility, the space 45 could be dispensed with.

Figure 16:
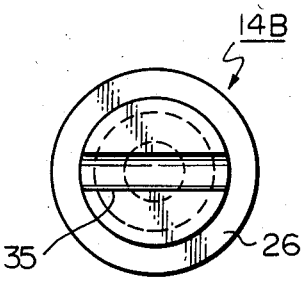
Figure 17:
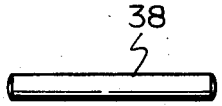
FIG. 17 is a side elevational view of a pin shown in FIGS. 13 and 14.
Figure 28:
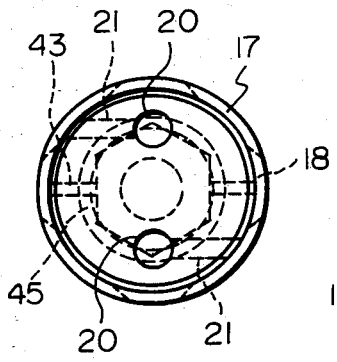
FIGS. 28 and 29 are bottom end and side elevational views of an assembly of a wad and a slug, according to another embodiment of the present invention, respectively; and, FIG. 30 shows a variant of the wad shown in FIG. 13.
Figure 29:
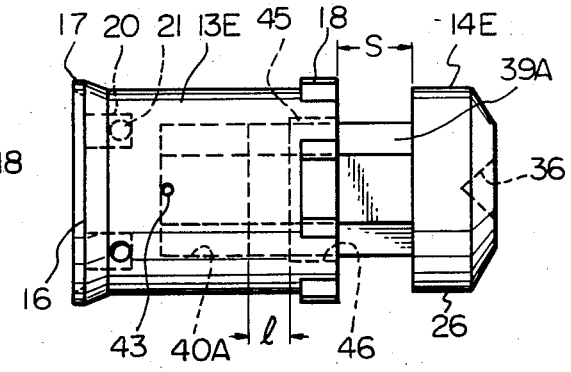

The embodiments mentioned above can be properly combined. One example of such a combination is illustrated in FIGS. 28 and 29, in which the wad 13E has the recess 16, the gas sealing projection 17, the projections 18, the blind holes 20, the restriction passages 21, similar to the wad 13B in FIG. 13. However, the hole 29 in FIG. 13 having a circle in section is replaced by a regular hexagonal cylinder bore 40A in FIGS. 28 and 29, which can be adapted not only to provide a cushion chamber but also to transmit the rotation (torque) of the wad to the slug. Therefore, neither pin 38 nor pin hole 37 is necessary in this embodiment shown in FIGS. 28 and 29. The wad 14E further includes vents 43 and the stepped portion 46 to provide the space 45, similar to the wad 13C shown in FIG. 27, which makes it possible to use the wad 13E for the choked barrel shotgun. On the other hand, the slug 14E which is connected to the wad 13E has the head 26 having the recess 36, similar to the slug 14B shown in FIG. 16. However, the cylindrical rod 27 in FIG. 16 is replaced by a regular hexagonal plunger 39A which can be press-fitted in the cylinder bore 40A.

Similar to FIG. 19, the plunger 39A is inserted in the cylinder bore 40A by the insertion length l. The reference "S" designates a cushion stroke.

As can be understood from the above discussion, according to the embodiment shown in FIGS. 28 and 29, since the wad 13E and the slug 14E are coaxially connected to each other on the same axis as that of the barrel bore and since their rotation stabilizes the attitude of the assembly of the wad and the slug, the hit probability can be highly increased. Furthermore, since the embodiment has a cushion device, the internal maximum pressure of the barrel bore can be decreased, which decreases undesirable recoil. Therefore, the shotgun load having the wad 13E and the slug 14E can be safely used together with a shotgun with a thin walled choked barrel. Furthermore, there is no possibility that lead of which the slug is made is stuck to or applied to the barrel bore. When the shotgun load hits a game animal, the kill power is increased by a so-called "mushroom" effect due to the presence of the recess 36.

Finally, since the wad and the slug according to the present invention have simple configurations, the wad can be manufactured by an injection molding and the slug can be manufactured by die-casting or centrifugal casting. The wad and the slug of the present invention can be also used for reloading a shotgun load.

I claim:

1. A wad for a shotgun cartridge having a case with a primer and powder therein, to be used with a slug which is held in the case by a crimp provided on the case and which has a diameter dimensioned such that an annular gap is provided between the inside surface of the case and the slug, said wad being located in the case between the powder and the slug, wherein said wad comprises:

a substantially solid cylindrical body having a longitudinal axis, front and rear end faces, a cylindrical side surface, and an outside diameter smaller than the inside diameter of the case;

said cylindrical body including a plurality of independent, symetrically-located blind holes which extend a predetermined relatively shallow distance thereinto parallel to and spaced from the longitudinal axis of the body, from the rear end face of the body adjacent to the powder;

means circumferentially attached about the cylindrical side surface of the body adjacent to the rear end face to define a continuous gas seal for preventing escape of explosive gas produced by combustion of the powder along the cylindrical side surface, and for centering the rear end face coaxial with the case;

said body further including a plurality of independent, non-radial and separate restriction passages individually connected to the blind holes and which extend perpendicularly to imaginary planes including the axes of the associated blind holes and the axis of the body to open to the cylindrical side surface of the wad body adjacent to said circumferential seal means so as to give a rotational torque in the same predetermined direction to the wad body when the explosive gas is discharged from the restriction passages;

said body being provided, on the portion of the cylindrical side surface adjacent to the front end face thereof, with a plurality of independent, segmental projections;

male and female connection means for coaxially and snugly connecting the wad body and the slug; and means for transmitting rotation of the wad body to the slug.

2. The shotgun wad according to claim 1, wherein said means attached to the portion of the cylindrical side surface of the wad body located adjacent to said powder comprises an annular projection having an outside diameter substantially identical to the inside diameter of the case and which is coaxial with the wad body.

3. The shotgun wad according to claim 1, wherein said independent segmental projections have a radius substantially identical to the radius of the inside surface of the case.

4. The shotgun wad according to claim 1, wherein said transmission means comprises male and female members which are connected together by means of a frictional press fit, thereby to prevent relative rotational slip therebetween.

5. The shotgun wad according to claim 1, wherein said transmission means comprises polygonal male and female members which are connected together to prevent any relative rotational slip therebetween.

* * * * *